US006392134B2

(12) United States Patent
Aoki

(10) Patent No.: US 6,392,134 B2
(45) Date of Patent: May 21, 2002

(54) APPARATUS AND METHOD FOR GENERATING AUXILIARY MELODY ON THE BASIS OF MAIN MELODY

(75) Inventor: Eiichiro Aoki, Hamamatsu (JP)

(73) Assignee: Yamaha Corporation (JP)

( * ) Notice: Subject to any disclaimer, the term of this patent is extended or adjusted under 35 U.S.C. 154(b) by 0 days.

(21) Appl. No.: 09/862,400

(22) Filed: May 22, 2001

(30) Foreign Application Priority Data

May 23, 2000 (JP) ..... 2000-151081

(51) Int. Cl.[7] ..... G10H 1/26
(52) U.S. Cl. ..... 84/609; 84/649
(58) Field of Search ..... 84/609–614, 649–652

(56) References Cited

U.S. PATENT DOCUMENTS 5,220,121 A 6/1993 Kawashima ..... 84/664

*Primary Examiner*—Stanley J. Witkowski
(74) *Attorney, Agent, or Firm*—Rossi & Associates

(57) ABSTRACT

Given melody notes are classified into particular notes and other notes than the particular notes in accordance with a predetermined criterion. Additional notes are decided with respect to the classified particular notes and the other notes in accordance with different criteria set for the classified particular notes and the other notes, to generate an auxiliary melody with the additional notes. For example, for each of the particular notes, an additional note is decided which has a predetermined musical interval from the particular note, so as to generate a plurality of additional notes with more emphasis on good sounding with the particular notes. For each of the other melody notes than the particular notes, an additional note is decided which has a musical interval determined on the basis of a flow of at least one of the main melody and the auxiliary melody, so as to generate additional notes with more emphasis on note-to-note connections of a generated auxiliary melody.

26 Claims, 4 Drawing Sheets

APPARATUS AND METHOD FOR GENERATING AUXILIARY MELODY ON THE BASIS OF MAIN MELODY

BACKGROUND OF THE INVENTION

The present invention relates generally to apparatus and methods for automatically generating an auxiliary melody (additional notes) corresponding to a given main melody, and more particularly an improved auxiliary melody generation apparatus and method capable of automatically generating and imparting an auxiliary melody (additional notes) to a main melody even where no chord progression is given.

With the widespread pervasion of personal computers, it has recently become possible for almost everyone to freely enjoy music in the form of computer music that uses a computer to, for example, perform a musical instrument, compose a music piece, arrange a music piece or synthesize a tone color. Particularly, in the field of computer-based automatic performance, there have been known auxiliary melody generation apparatus which are designed to, when an automatic performance is to be executed on the basis of a desired main melody selected by a user, automatically generate an auxiliary melody (additional notes) corresponding to the main melody. By the auxiliary melody generation apparatus thus automatically generating an auxiliary melody (additional notes) corresponding to a desired main melody, it is possible to execute, in a simplified manner, a harmony performance, such as a duet where a single auxiliary melody is imparted to the main melody or a trio where two auxiliary melodies are imparted to the main melody.

Generally, the conventional auxiliary melody generation apparatus are designed to automatically generate additional notes on the basis of individual melody notes constituting a selected main melody and chords corresponding to the main melody and impart, to the main melody, the thus-generated additional notes as an auxiliary melody. Thus, for impartment of the auxiliary melody, it is necessary to give the chords in addition to the main melody; that is, the conventional auxiliary melody generation apparatus are unable to impart an auxiliary melody unless chords are given. Among approaches for providing a solution to such an inconvenience is to constantly detect chords from the main melody and automatically generate additional notes on the basis of the detected chords. This approach is, however, disadvantageous in that there would be required a more complicated program for automatically generating an auxiliary melody and a greater storage capacity would be required for storing the complicated auxiliary-melody generating program.

Further, because the conventional auxiliary melody generation apparatus are designed only to impart additional notes to melody notes in such a manner that the additional notes match chords corresponding to the main melody, the imparted additional notes tend to present an unsmooth flow of notes (note-to-note connections), so that human listeners listening only to the auxiliary melody (additional notes) would feel musical unnaturalness and unsmoothness.

SUMMARY OF THE INVENTION

In view of the foregoing, it is an object of the present invention to provide an auxiliary melody generation apparatus and method which can automatically generate an auxiliary melody (or additional notes) corresponding to a main melody without requiring chords.

It is another object of the present invention to provide an auxiliary melody generation apparatus and method which can generate an auxiliary melody (or additional notes) having natural note-to-note connections and an enhanced musical completeness or perfection.

In order to accomplish the above-mentioned objects, the present invention provides an auxiliary melody generation apparatus which comprises: a melody information supply device that supplies melody information of a given main melody; and a processor device coupled with the melody information supply device. The processor device is adapted to: classify melody notes into particular notes and other notes than the particular notes, on the basis of the melody information supplied by the melody information supply device and in accordance with a predetermined criterion; and decide additional notes with respect to the classified particular notes and the other notes in accordance with different criteria set for the classified particular notes and the other notes. Thus, an auxiliary melody is composed of the additional notes decided by the processor device.

For each of the classified particular notes, the processor device may decide an additional note having a predetermined musical interval from the particular note, and for each of the other notes than the particular notes, the processor device may decide an additional note having a musical interval determined on the basis of a flow of at least one of the main melody and the auxiliary melody. The processor device may classify the melody notes into the particular notes and the other notes than the particular notes, on the basis of at least one of a downbeat note, note near a downbeat position and long-duration note.

According to the present invention, a given melody notes are classified into particular notes and other notes than the particular notes in accordance with a predetermined criterion. Additional notes are decided with respect to the classified particular notes and the other notes in accordance with different criteria set for the classified particular notes and the other notes. For example, for the particular notes, additional notes are decided which have predetermined musical intervals from the particular notes, so as to generate additional notes with more emphasis on good sounding with the particular notes. For the other melody notes than the particular notes, on the other hand, additional notes are decided which have musical intervals determined on the basis of a flow of at least one of the main and auxiliary melodies, so as to generate additional notes with more emphasis on note-to-note connections of a generated auxiliary melody. This way, it is possible to generate an auxiliary melody from the main melody without necessarily requiring chords. The auxiliary melody that is musically natural can be imparted to the main melody.

The present invention may be constructed and implemented not only as the apparatus invention as discussed above but also as a method invention. Also, the present invention may be arranged and implemented as a software program for execution by a processor such as a computer or DSP, as well as a storage medium storing such a program. Further, the processor used in the present invention may comprise a dedicated processor with dedicated logic built in hardware, not to mention a computer or other general-purpose type processor capable of running a desired software program.

While the embodiments to be described herein represent the preferred form of the present invention, it is to be understood that various modifications will occur to those skilled in the art without departing from the spirit of the invention. The scope of the present invention is therefore to be determined solely by the appended claims.

BRIEF DESCRIPTION OF THE DRAWINGS

For better understanding of the object and other features of the present invention, its embodiments will be described in greater detail hereinbelow with reference to the accompanying drawings, in which:

FIGS. 3A to 3C are conceptual diagrams explanatory of a manner in which additional notes are imparted, by the auxiliary melody generation processing, to the main melody, of which FIG. 3A shows a musical score of only the main melody to which an auxiliary melody is to be imparted, FIG. 3B shows a musical score of the main melody plus additional notes of the auxiliary melody that are imparted only to important notes and note at the beginning of a music piece and FIG. 3C shows a musical score of the main melody plus additional notes of the auxiliary melody that are imparted to all the component notes of the main melody.

DETAILED DESCRIPTION OF EMBODIMENTS

Figure 1:
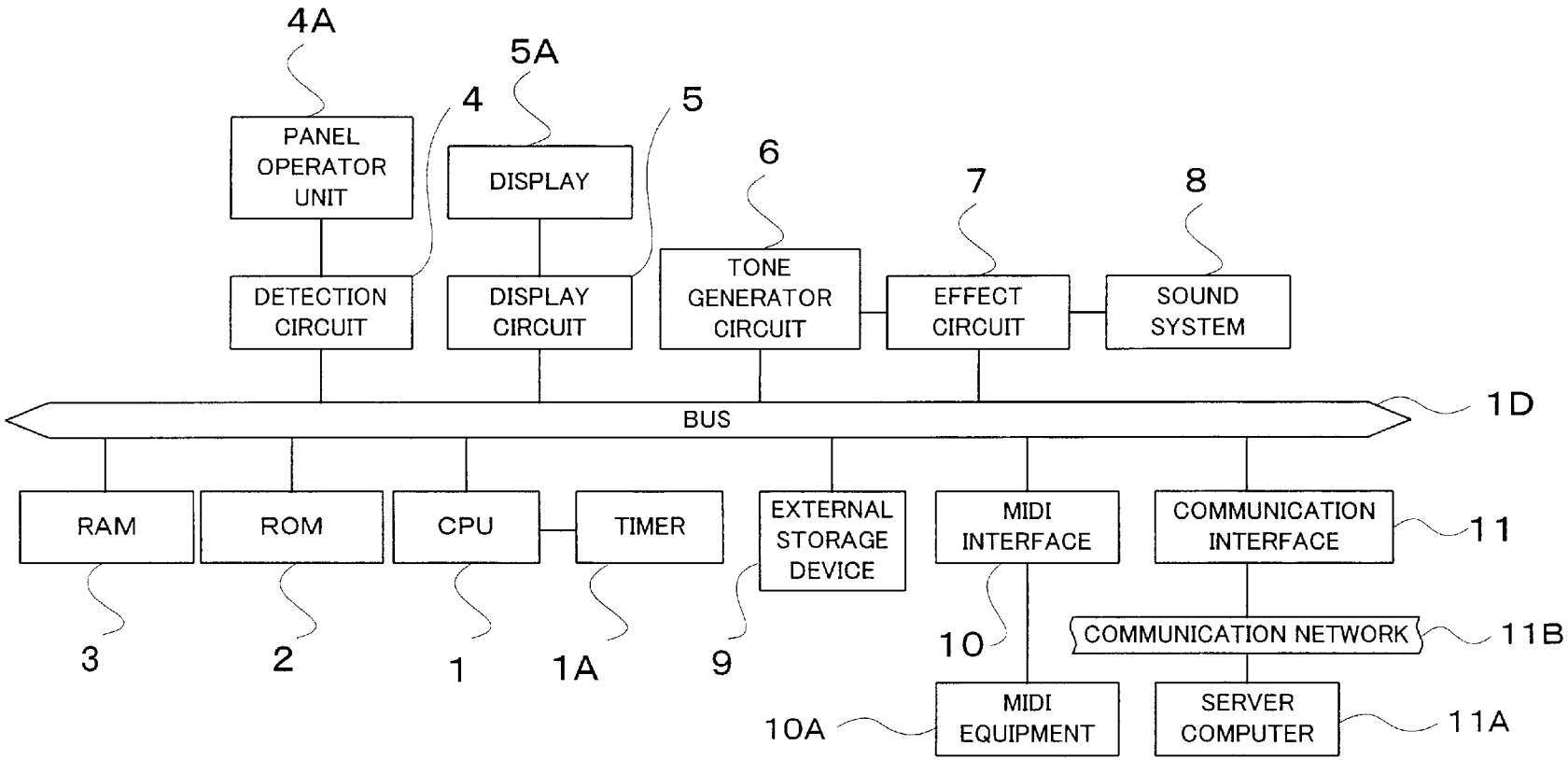
FIG. 1 is a block diagram illustrating a general hardware setup of an auxiliary melody generation apparatus in accordance with an embodiment of the present invention.

FIG. 1 is a block diagram illustrating a general hardware setup of an auxiliary melody generation apparatus according to an embodiment of the present invention.

This auxiliary melody generation apparatus is controlled by a microcomputer comprising a microprocessor unit (CPU) 1, a read-only memory (ROM) 2 and a random-access memory (RAM) 3. The CPU 1 controls general operation of the auxiliary melody generation apparatus. To the CPU 1 are connected, via a data and address bus 1D, the read-only memory 2, random-access memory 3, detection circuit 4, display circuit 5, tone generator (T.G.) circuit 6, effect circuit 7, external storage device 9, MIDI interface (I/F) 10 and communication interface 11. Also connected to the CPU 1 is a timer 1A for counting various time periods, for example, to signal interrupt timing for a timer interrupt process. Namely, the timer 1A generates tempo clock pulses for counting a time interval or setting a performance tempo with which to automatically perform a music piece (that may be one including main and auxiliary melodies, one including main and auxiliary melodies and an accompaniment, or the like). The frequency of the tempo clock pulses is adjustable via an panel operator unit 4A including various switches, operators, etc. Such tempo clock pulses generated by the timer 1A are given to the CPU 1 as processing timing instructions or as interrupt instructions. The CPU 1 carries out various processes in accordance with such instructions. The various processes carried out by the CPU 1 in the instant embodiment include processes relating to screen displays, automatic performance of a selected music piece, etc.

The ROM 2 has prestored therein various programs to be executed by the CPU 1 and various data to be referred to by the CPU 1 (such as performance data like main melody data and auxiliary melody data). The RAM 3 is used as a working memory for temporarily storing various tone information, automatic performance information to be used for automatically performing a desired music piece or various data generated as the CPU 1 executes the program, or as a memory for storing the currently-executed program and data related thereto. Predetermined address regions of the RAM 3 are allocated and used as registers, flags, tables, etc.

The panel operator unit 4A includes various switches and operators for designating various parameters, inputting musical condition parameters to be used for automatically performing a music piece. For example, the panel operator unit 4A may include a ten-button keypad for entry of numeric value data, a keyboard for entry of text data, and panel switches. Of course, the panel operator unit 4A may also include operators for selecting, setting and controlling a tone pitch, color, effect, etc. The detection circuit 4 constantly detects respective operational states of the individual operators on the panel operator unit 4A and outputs switch information, corresponding to the detected operational states of the operators, to the CPU 1 via the data and address bus 1D. The display circuit 5 visually displays various information, such as contents of the musical condition parameters, on a display 5A that may comprise an LCD (Liquid Crystal Device) or CRT (Cathode Ray Tube). In addition, the display circuit 5 displays on the display 5A various information of a music piece being currently automatically performed, controlling state of the CPU 1, etc.

The tone generator (T.G.) circuit 6, which is capable of simultaneously generating tone signals in a plurality of channels, receives tone information (such as performance data and musical condition parameters) supplied via the data and address bus 1D and generates tone signals based on the received tone information. Each of the tone signals thus generated by the tone generator circuit 6 is audibly reproduced or sounded by a sound system 8 including speakers and amplifiers. The effect circuit 7 imparts various effects to the tone signals generated by the tone generator circuit 6. Any desired tone signal generation method may be used in the tone generator circuit 6, such as: the memory readout method where sound waveform sample value data stored in a waveform memory are sequentially read out in accordance with address data that vary in correspondence to the pitch of a tone to be generated; the FM method where sound waveform sample value data are obtained by performing predetermined frequency modulation operations using the above-mentioned address data as phase angle parameter data; or the AM method where sound waveform sample value data are obtained by performing predetermined amplitude modulation operations using the above-mentioned address data as phase angle parameter data. Rather than the above-mentioned, the tone generator circuit 6 may use the physical model method, harmonics synthesis method, formant synthesis method, analog synthesizer method using a combination of VCO, VCF and VCA, or analog simulation method. Further, the tone generator circuit 6 may be implemented by a combined use of a DSP and microprograms or of a CPU and software programs, rather than by use of dedicated hardware. The tone generation channels to simultaneously generate a plurality of tone signals in the tone generator circuit 6 may be implemented either by using a single circuit on a time-divisional basis or by providing a separate circuit for each of the channels.

The external storage device 9 is provided for storing the musical condition parameters and performance data (such as main and auxiliary melody data) to be used for automatic performance of any desired music piece and data relating to control of the various programs for execution by the CPU 1. Where a particular control program is not prestored in the ROM 2, the control program may be prestored in the external storage device (e.g., hard disk device) 9, so that, by reading the control program from the external storage device 9 into the RAM 3, the CPU 1 is allowed to operate in exactly the same way as in the case where the particular control program is stored in the program memory 2. This arrangement greatly facilitates version upgrade of the control program, addition of a new control program, etc. The external storage device 9 may use any of various removable-type media other than the hard disk (HD), such as a floppy disk (FD), compact disk (CD-ROM or CD-RAM), magneto-optical disk (MO), digital versatile disk (DVD) and semiconductor memory card.

The MIDI interface (I/F) 10 is provided for receiving or delivering MIDI tone information (MIDI data) from or to other MIDI equipment 10A or the like outside the auxiliary melody generation apparatus. Note that the other MIDI equipment 10A may be of any type, such as the keyboard type, guitar type, wind instrument type, percussion instrument type or gesture type, as long as it can generate MIDI data in response to manipulations by a user or player. Further, the communication interface 11 is connected to a communication network 11B, such as a LAN (Local Area Network), the Internet or telephone line network, via which it may be connected to a desired sever computer 11A so as to input a desired control program and various data to the auxiliary melody generation apparatus of the invention. Thus, in a situation where a particular control program and various data are not contained in the ROM 2 or external storage device (hard disk) 9, these control program and data can be downloaded from the server computer 11A via the communication interface 11. In such a case, the auxiliary melody generation apparatus, which is a "client", sends a command to request the server computer 11A to download the control program and various data by way of the communication interface 11 and communication network 11B. In response to the command sent from the client, the server computer 11A delivers the requested control program and data to the auxiliary melody generation apparatus via the communication network 11B. The auxiliary melody generation apparatus receives the control program and data via the communication interface 11 and accumulatively store them into the external storage device (hard disk) 9. In this way, the necessary downloading of the control program and various data is completed.

Note that the MIDI interface 10 may be a general-purpose interface rather than a dedicated MIDI interface, such as RS232-C, USB (Universal Serial Bus) or IEEE1394, in which case other data than MIDI event data may be communicated at the same time. In the case where such a general-purpose interface as noted above is used as the MIDI interface 10, the other MIDI equipment 10A may be designed to communicate other data than MIDI event data. Of course, the musical information handled in the present invention may be of any other data format than the MIDI format, in which case the MIDI interface 10 and other MIDI equipment 10A are constructed in conformity to the data format employed.

It should be appreciated that the inventive auxiliary melody generation apparatus need not necessarily be a dedicated apparatus and may be a general-purpose apparatus such as a personal computer, multimedia equipment or communication terminal like a cellular phone. Namely, the auxiliary melody generation apparatus may be of any type as long as it is constructed to automatically generate an auxiliary melody using predetermined software or hardware based on the principles of the present invention. In the case where the inventive auxiliary melody generation apparatus is constructed as a portable communication terminal, the external storage device 9 may be dispensed with; in this case, it is only necessary that the portable communication terminal be provided with a rewritable data memory such as a flash memory or RAM backed up by a battery. Also, the portable communication terminal may dispense with the MIDI interface 10.

Figure 2:
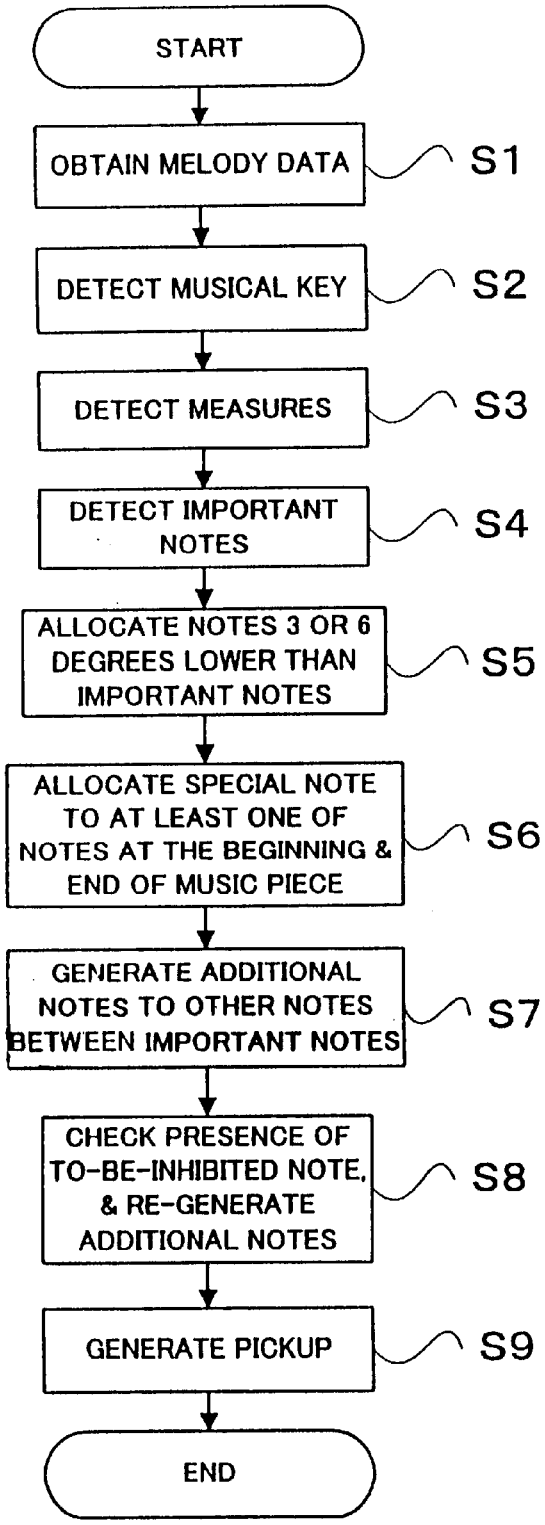
FIG. 2 is a flow chart showing an exemplary step sequence of auxiliary melody generation processing for generating an auxiliary melody on the basis of a main melody.

The auxiliary melody generation apparatus of the present invention is designed to generate an auxiliary melody (auxiliary melody data) on the basis of an input main melody (main melody data). Thus, the following paragraphs describe, with reference to FIG. 2, processing in accordance with which the auxiliary melody generation apparatus generates an auxiliary melody (auxiliary melody data) on the basis of an input main melody (main melody data). FIG. 2 is a flow chart showing an exemplary step sequence of the auxiliary melody generation processing carried out in the instant embodiment.

At step S1 of the auxiliary melody generation processing of FIG. 2, the auxiliary melody generation apparatus obtains (is supplied with) main melody data, for example, by loading an existing music piece from a predetermined database, downloading existing main melody data from a Web server WS on the communication network 11B, or receiving main melody data attached to an electronic mail. Alternatively, the auxiliary melody generation apparatus may obtain main melody data that have been generated in real time by a user entering a desired melody using the panel operator unit 4A or keyboard. In another alternative, the auxiliary melody generation apparatus may obtain main melody data automatically generated through automatic composition, or obtain main melody data by sequentially reading out automatic performance data stored in memory.

At next step S2, a predetermined process is carried out on the main melody data, obtained at step S1, for detecting a musical key of the main melody data. The process for detecting the musical key of the main melody data itself is conventionally known and will not be detailed here. According to one known example of the musical-key detecting process, comparisons may be sequentially made between the individual component notes of the obtained main melody and scale notes of the individual musical keys so that one of the musical keys having a greatest number of scale notes matching the main-melody component notes is determined as the musical key of the main melody. Pitches of additional notes (i.e., individual component notes of an auxiliary melody) to be added to the individual component notes of the main melody in a later-described process are all set on the basis of the scale notes of the musical key of the main melody detected at step S2. Assume here that in a situation where a certain section, such as a two-beat section or one-measure section, of the main melody contains a note expressed by a predetermined musical symbol such as "♯" (sharp) or "♭" (flat), an additional note corresponding to the main melody note is imparted with the same musical symbol such as "♯" or "♭" as added to the main melody note. For example, where a certain section of the main melody in the C major key contains a note "F♯" and an additional note three degrees lower than a main melody note "A" in that section is to be added to the note, "F♯" rather than "F" is imparted.

At step S3, the main melody data are divided on a measure-by-measure basis. The measure-by-measure division of the main melody data will facilitate detection, at following step S4, of important notes in each of the measures. More specifically, at step S4, important notes are detected from among individual component notes, in each of the measures, of the main melody. For example, in each of the measures, at least one of 1) a note at a downbeat position, 2) a note near a downbeat position if no note is present at a downbeat position or 3) a note of a predetermined length or duration (e.g., a half note) is detected as the important note. However, any other suitable note than such notes may be detected as the important note. For example, a highest-pitch note in a certain phrase, accented note or first note after a key change may be detected as the important note; in this case, there is no need to divide the main melody data on the measure-by-measure basis for the purpose of detecting the important notes.

Note that data indicative of the "musical key", "measure-by-measure divisions" and "important notes" of the main melody, which are to be detected at steps S2 to S4 as noted above, may be previously inserted in the main melody data. In such a case, the operations of S2 to S4 can be omitted, and thus the auxiliary melody generation processing can be significantly simplified. As a consequence, additional notes can be generated in a reduced time, and a storage capacity for the processing program can also be reduced to a considerable degree.

At next step S5, a note three or six degrees lower than each of the important notes, detected at step S4, is allocated as an additional note to the important note. The allocation of the additional notes may be made randomly or in accordance with a predetermined rule. For example, which one of the notes lower than the important note by three and six degrees should be allocated may be decided depending on the pitch (range) of the important note in question. In this way, an additional note is allocated to the important note in each of the measures of the main melody. Once additional notes have been imparted to all of the important notes in the main melody, a special note is imparted to at least one of the notes at the beginning and end of the music piece, at step S6. If the tonic or keynote of the musical key is imparted to the notes at the beginning and end of the music piece, the music piece can present a feeling of paragraph, i.e. settlement. Similar special note may be imparted to another suitable note than the above-mentioned notes at the beginning and/or end of the music piece, such as a note of a long duration like a whole note or notes at the beginning and/or end of a phrase in the music piece, which presents a feeling of settlement at an along-the-way or intermediate point of the music piece (such a note will hereinafter be called a "paragraph note"). Note that the operation of step S6 is not always necessary and may be omitted as appropriate.

In the above-mentioned manner, the auxiliary melody generation processing first sets additional notes only with respect to particular main-melody notes (important notes and notes at the beginning and/or end of the music piece).

Then, at following step S7, the auxiliary melody generation processing generates additional notes with respect to other notes present between the important notes in the main melody. For example, one additional note is generated with respect to one component note of the main melody between the important notes and such additional note generation is effected sequentially with respect to the individual component notes of the main melody, in accordance with the following predetermined musical rules. As one example, the following musical rules are applied in turn starting with Musical Rule 1.

Musical Rule 1

Additional notes three or six degrees lower than the corresponding main-melody component notes are generated in such a manner that the additional notes progress in a "gradual (namely, two-degree) progression style" (i.e., in a style where one additional note shifts to a next additional note immediately adjacent to (two degrees higher or lower) than the one or preceding note on the scale).

Musical Rule 2

If the gradual progression is impossible or inapplicable, additional notes three, four or six degrees lower than the corresponding main-melody component notes are generated in such a manner that the additional notes progress in a "same-pitch progression style" (i.e., in a style where one additional note shifts to a next additional note having the same pitch as the one or preceding additional note).

Musical Rule 3

If both of the above-mentioned gradual progression and same-pitch progression are impossible or inapplicable, additional tones three or six degrees lower than the corresponding main-melody component notes may be generated in such a manner that the additional notes progress in a "leap progression style" (i.e., in a style where one additional note leaps to a next additional note having a relatively great musical interval from the one or preceding additional note). However, after the leap progression, a still next additional note three or six degrees lower than the corresponding main-melody component note is generated in such a manner that the additional notes progress in the "gradual progression style" (i.e., in a style where the leaped additional note shifts to the next additional note immediately adjacent to (two-degree higher or lower) than the leaped note on the scale). After the gradual progression following the leap progression, there may again take place a leap progression.

By sequentially generating additional notes with respect to the individual component notes of the main melody while applying such musical rules as appropriate, it is possible to generate a preferable auxiliary melody with musically natural note-to-note connections.

At step S8, a check is made to see whether the generated additional notes include any note that is to be musically inhibited or musically non-preferable. If the generated additional notes include such a to-be inhibited or musically non-preferable note, an auxiliary melody is re-generated; that is, additional notes are generated again with respect to all the component notes of the main melody. Further, if the component note of the main melody for which an additional note is to be generated is a note having a predetermined length (e.g., a half note length) or longer or a rest having a predetermined length (e.g., a half rest length) or longer, one or more additional notes are generated, at step S9, in such a way as to create a pickup (e.g., a decorative passage used at the beginning of a melody line or at the end of a phrase) such as an Auftakt. For example, with respect to a portion of the main melody where there is a note having a length equal to or longer than a half note or longer or a rest having a length equal to or longer than a half rest, one or more additional notes are generated so that the notes connect to the start of a next measure in the gradual (two-degree) progression style. Note that the operations of steps S8 and S9 are not always necessary and may be omitted. By thus sequentially generating and imparting additional notes to the individual component notes of the main melody, an auxiliary melody to the main melody can be created as a whole.

Whereas the auxiliary melody generation processing has been described above as creating an auxiliary melody by imparting additional notes to the component notes of the main melody in a one-to-one relationship, the present invention is not so limited; for example, one additional note may be imparted to two or more component notes of the main melody, or two or more additional notes may be imparted to one component note of the main melody. For instance, two eighth notes of the auxiliary melody may be imparted to a quarter note of the main melody, or a quarter note of the auxiliary melody may be imparted to two eighth notes of the main melody. Further, additional notes progressing in the same-pitch progression style may be changed to a single longer note by being connected by a tie. Furthermore, auxiliary melodies of a plurality of parts may be imparted to the main melody. For example, in a situation where two additional notes of two auxiliary parts are to be generated at a time, both of (rather than just one of) the additional notes lower than the corresponding main-melody component note by three and six degrees are simultaneously allocated to the component note (at step S5 of FIG. 2). However, it is preferable that notes lower than the important note by three and six degrees be not allocated as additional notes; for example, notes lower than the main-melody component note by three and five degrees, four and six degrees, four and eight degrees, or the like may be allocated as additional notes to the main-melody component note. Because, if such notes lower than the important note by three and six degrees are allocated as additional notes of the auxiliary parts, the musical interval between the additional notes (i.e., notes lower than the important note by three and six degrees) is four degrees that will result in very poor sounding. Further, in a situation where three additional notes of three auxiliary parts are to be generated at a time, one more additional note is generated in addition to the two additional notes generated as in the above-mentioned two-auxiliary-part case. Namely, in the case where two or more additional notes are to be generated at a time, plural additional notes to be imparted to individual main-melody notes between the important notes are decided as follows. First, for the highest-pitch additional note of a plurality of last-generated additional notes, a next additional note is decided such that it progresses from the last highest-pitch additional note in the same-pitch progression style or gradual progression style. Then, for the second-highest-pitch additional note of the plurality of last-generated additional notes, a next additional note is decided such that it progresses from the last second-highest-pitch additional note in the same-pitch progression style or gradual progression style. Similar additional note decision applies to the lowest-pitch additional note of the plurality of last-generated additional notes. Note that in this case, the additional notes to be imparted need not necessarily be lower than the corresponding main-melody component tone by three and six degrees.

It should be appreciated that the musical rules to be applied in generating the additional notes are not limited to the above-mentioned; the additional notes may be generated in accordance with other musical rules than the above-mentioned musical rules, or modified versions of the above-mentioned musical rules. For example, although the auxiliary melody generation processing of the present invention has been described above as generating an additional note lower than the corresponding component note of the main melody by three or six degrees (or four degrees in the case of the same-pitch progression) when the additional note is to be generated in the same-pitch progression or gradual progression style, it may be arranged to generate an additional note four or five degrees lower than the corresponding main-melody component note; alternatively, an additional note two, four or six degrees lower than the corresponding main-melody component note may be generated as a tension note. In another modification, parameters may be set to control these possible additional notes so that any one of the notes is selected in accordance with the parameters. For example, by setting control parameters for each section, such as a measure, so as to control additional notes for each section on the basis of the control parameters, it is possible to generate an auxiliary melody rich in variations and ups and downs. Arrangements may be made such that desired musical conditions of the additional notes can be designated in accordance with a musical genre or emotional words of a desired auxiliary melody. For example, when "jazz" is designated as the musical genre, a tension note seven or nine degrees lower than the corresponding main-melody component note may be generated as the additional note. When "simplicity" is designated as the emotional words, only a note three degrees lower than corresponding the main-melody component note may be generated as the additional note.

Further, the auxiliary melody generation processing of the present invention has been described above as generating additional notes with emphasis on smoothing a flow of notes. However, if the main and auxiliary melodies are of a same tone color or similar tone colors, then a timewise flow of notes of the auxiliary melody would be difficult to catch. Thus, in such a case, additional notes may be generated with emphasis on optimal mutual sounding of the notes of the main and auxiliary melodies; for example, the musical intervals of the additional notes from the corresponding main-melody component notes are limited to three and six degrees, so as to achieve optimal mutual sounding of the notes of the main and auxiliary melodies. Conversely, if the main and auxiliary melodies extremely differ from each other in tone color, then a timewise flow of notes of the auxiliary melody would be much easier to catch, so that in this case, additional notes may be generated with more emphasis on an optimal flow of the notes of the auxiliary melody; for example, the musical interval of each additional note from the corresponding main-melody component note may be selected from among a wide variety of candidate musical intervals such as one, three, four, five, six and eight degrees, so as to achieve an optimal flow of the notes. Further, the priority to the optimal sounding or the priority to the optimal flow of the notes may be automatically selected depending on whether or not the main and auxiliary melodies are of a same tone color, or may be selected by the user. In an alternative, the priority to the optimal mutual sounding the notes of the main and auxiliary melodies or the priority to the optimal flow of the notes of the auxiliary melody may be selected in accordance with the musical genre; for example, for a classical music piece, the flow of the notes may be given priority over the mutual sounding of the notes of the main and auxiliary melodies in the case of a classical music piece, and the mutual sounding may be given priority over the flow of the notes in the case of a jazz-like music piece.

Additional note may be decided in any other suitable manner than randomly. For example, a plurality of candidate additional notes may be presented to the user by being visually displayed on the display 5A or audibly sounded so that the user can select and decide any one of the candidate additional notes as the additional note.

Figure 3A:
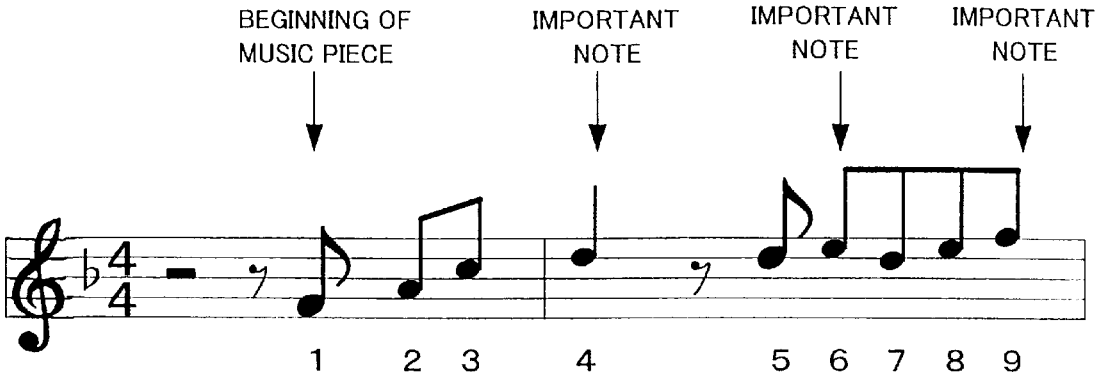
Figure 3B:
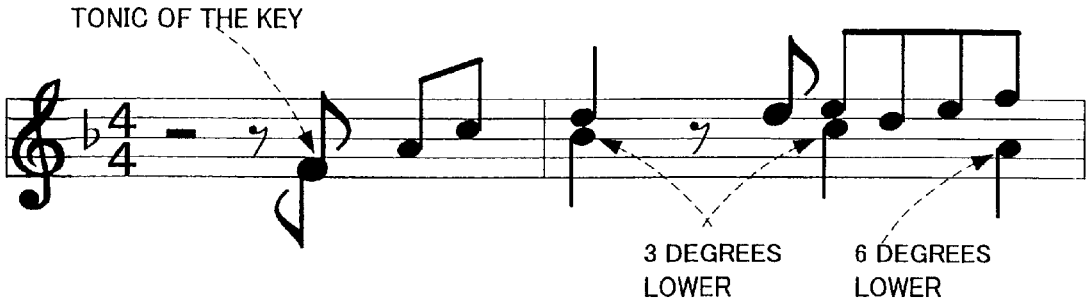
Figure 3C:
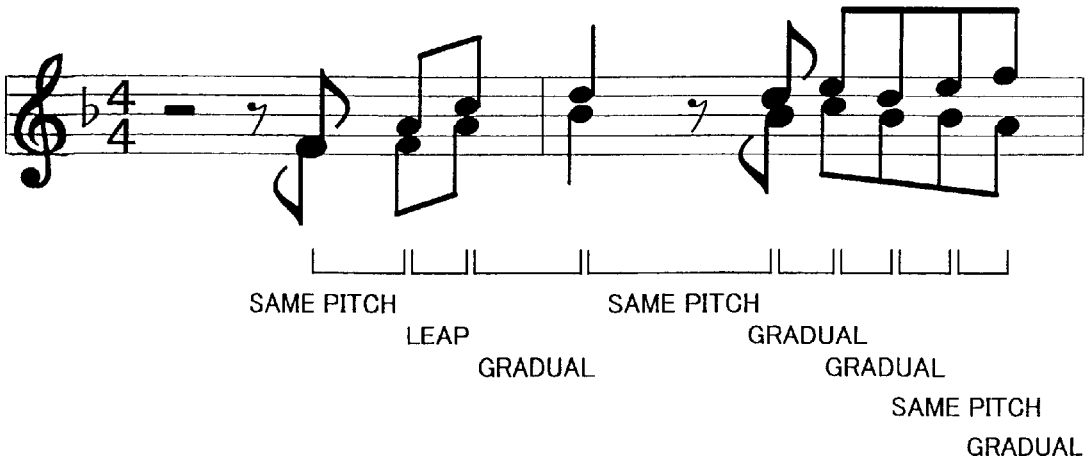

The above-described auxiliary melody generation processing will be described in greater detail. FIGS. 3A to 3C are conceptual diagrams explanatory of a specific manner in which additional notes are imparted, by the auxiliary melody generation processing, to the main melody. More specifically, FIG. 3A shows a musical score of only the main melody to which an auxiliary melody is to be imparted by the auxiliary melody generation processing, FIG. 3B shows a musical score of the main melody plus additional notes of the auxiliary melody that are imparted only to important notes and note at the beginning of the music piece, and FIG. 3C shows a musical score of the main melody plus additional notes of the auxiliary melody that are imparted to all the component notes of the main melody.

The following paragraphs describe in more detail the auxiliary melody generation processing of FIG. 2, with reference to FIGS. 3A to 3C. However, for simplicity of illustration and description, FIGS. 3A to 3C show only first two measures of the main melody, and a description is made in relation to a case where additional notes of the auxiliary melody are imparted to the individual notes of the first two measures of the main melody. Also, let's assume that the auxiliary melody generation processing is initiated after the main melody data as shown in FIG. 3A have already been obtained or supplied from a predetermined source (see step S1 of FIG. 2), the F major has been detected as the musical key of the main melody (i.e., "F" has been detected as the tonic) (see step S2 of FIG. 2) and important notes of the main melody have been detected on the measure-by-measure basis (see steps S3 and S4 of FIG. 2). Namely, the operations at and after steps S5 of FIG. 2 will be described hereinbelow. In the illustrated example, three important notes (note 4, note 6 and note 9) have been detected; note that numerical values written below the musical score of FIG. 3A in corresponding relation to the individual component notes of the main melody are intended to identify the notes just for explanation purposes.

In the auxiliary melody generation processing, notes three or six degrees lower than the detected important notes are first allocated randomly as additional notes to the important notes (see step S5 of FIG. 2). In the illustrated example of FIG. 3B, important note 4 and important note 6 are imparted with additional notes three degrees lower than the important notes, and important note 9 is imparted with an additional note six degrees lower than the important note. Further, a special note, i.e. the tonic "F" of the musical key (F major) of the main melody, is imparted as an additional note to note 1 at the beginning of the music piece (see step S6 of FIG. 2). In this way, additional notes to particular notes of the main melody are decided one by one.

Then, additional notes are imparted to other notes of the main melody than the particular notes; that is, additional notes are generated and imparted to the other notes (note 2, note 3, note 5, note 7 and note 8) than note 1 at the beginning of the music piece, important note 4, important note 6 and important note 9. In the illustrated example of FIG. 3C, additional notes are imparted to the main-melody component notes in a one-to-one relationship. If an additional note making the gradual progression is considered with respect to note 2 between note 1 at the beginning of the music piece and important note 4, the additional note will be two or four degrees lower than note 2, and therefore Musical Rule 1 can not be applied in this case. If an additional note making the same-pitch progression is considered, the additional note will be three degrees lower than note 2, and thus Musical Rule 2 can be applied here. Therefore, the additional note three degrees lower than note 2 which makes the same-pitch progression is adopted here. Then, if an additional note making the gradual progression is considered with respect to note 3, the additional note will be four or six degrees lower than note 3, and it appears that the additional note six degrees lower than note 3 can be adopted here; however, such an additional note six degrees lower than note 3 will undesirably present a leap relative to the additional note of important note 4, and thus Musical Rule 1 can not be applied in this case. If an additional note making the same-pitch progression is considered with respect to note 3, the additional note will also undesirably present a leap relative to the additional note of important note 4, and thus Musical Rule 2 can not be applied too. Therefore, Musical Rule 3 is applied here to permit the leap. In this case, the additional note three degrees lower than the corresponding main melody note makes the gradual progression relative to the additional note of important note 4, but the additional note six degrees lower than the main melody note presents a leap, and thus the note three degrees lower than the main melody note is adopted. In this way, the additional notes to main melody note 1 to important note 4 are decided so that the same-pitch progression, leap progression and gradual progression take place. Similarly, by application of Musical Rule 1 to Musical Rule 3, additional notes to main melody note 5, note 7 and note 8 are decided so that the same-pitch progression, gradual progression and same-pitch progression take place; that is, main melody note 5 is imparted with an additional note three degrees lower than the main melody note, main melody note 7 is imparted with an additional note three degrees lower than the main melody note, and main melody note 8 is imparted with an additional note four degrees lower than the main melody note. This way, additional notes are decided with respect to the individual main melody notes other than the note at the beginning of the music piece and important notes, and thereby the combination of the additional notes to the note at the beginning of the music piece and important notes and additional notes to the other notes of the main melody constitutes an auxiliary melody corresponding to the entire main melody. The thus-generated auxiliary melody may be sounded in real time along with the main melody. Further, performance data of the main melody and performance data of the auxiliary melody may be stored in the external storage device 9 or the like either in combination or independently of each other.

In an automatic performance, a tone color with which the generated auxiliary melody is automatically performed may be either the same as or different from a tone color with which the main melody is automatically performed. Further, a tone volume (velocity) with which the generated auxiliary melody is automatically performed may be either the same as or different from a tone volume with which the main melody is automatically performed. It is however preferable that the tone volume with which the generated auxiliary melody is automatically performed be lower than the tone volume with which the main melody is automatically performed. Further, the tone volume with which the generated auxiliary melody is automatically performed may be decided on the basis of the tone volume with which the main melody is automatically performed; for example, 80% of the tone volume with which the main melody is automatically performed may be decided as the tone volume with which the generated auxiliary melody is automatically performed. Gate time may be the same for the main and auxiliary melodies, or different between the main and auxiliary melodies; for example, the gate time of the auxiliary melody may be set to be shorter than that of the main melody.

Figure 4:
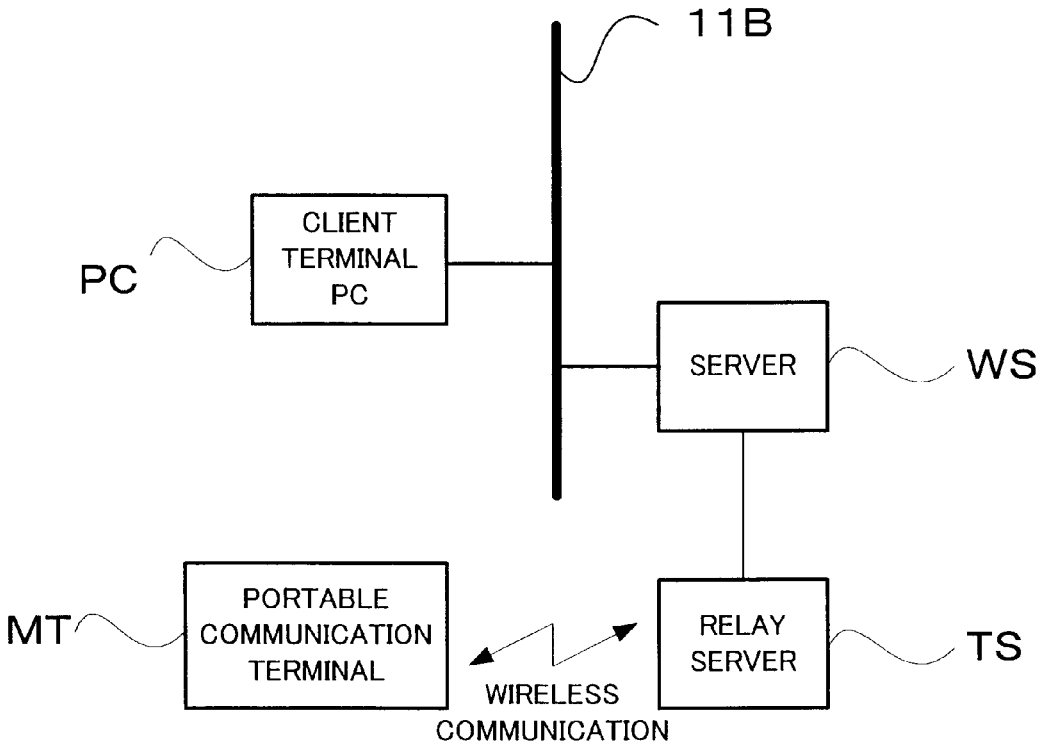
FIG. 4 is a block diagram outlining a system where an automatic performance is carried out using an auxiliary melody generated by a server.

In the case where the auxiliary melody generation apparatus comprises a general-purpose apparatus such as a personal computer (which will hereinafter be called a "client terminal PC") or a portable communication terminal, a system may be organized such that an auxiliary melody generated via a predetermined server is delivered to the client terminal PC or portable communication terminal so that the client terminal PC or portable communication terminal can carry out an automatic performance using the received auxiliary melody. Namely, the system may be organized such that by the server generating an auxiliary melody, the client terminal PC or portable communication terminal is allowed to carry out an automatic performance without having to generate an auxiliary melody. Such a system will be described briefly with reference to FIG. 4. FIG. 4 is a block diagram outlining the system where an automatic performance is carried out using an auxiliary melody generated by the server.

The system of FIG. 4 includes a Web server WS, relay server TS, communication network 11B, client terminal PC and portable communication terminal MT. Each of the components (Web server WS, relay server TS, communication network 11B, client terminal PC and portable communication terminal MT) of the system comprises an independent computer that includes a CPU 1, ROM 2, RAM 3, communication interface 11 (see FIG. 1), etc. as described earlier in relation to FIG. 1. Thus, each of the various components can transmit or receive various data (performance data such as main melody data or auxiliary melody data) through wired communication via the communication network 11B, dedicated communication line, etc. or through wireless communication via the relay server TS etc. However, the Web server WS and relay server TS each need not include the tone generator circuit 6, effect circuit 7 and sound system 8 as shown in FIG. 1, and the portable communication terminal MT need not include the external storage device 9 as shown in FIG. 1.

The system of FIG. 4 may of course include other hardware components than the Web server WS, relay server TS, communication network 11B, client terminal PC and portable communication terminal MT, but a description will be made hereinbelow in relation to a case where only minimum necessary resources are employed.

In the instant embodiment, the Web server WS is a server computer which has installed therein software programs for generating an auxiliary melody. The Web server WS and client terminal PC are interconnected via the communication network 11B such as a LAN (Local Area Network), Internet and/or telephone line network. Thus, by connecting the client terminal PC to the communication network 11B and accessing (e.g., designating the uniform resource locator or URL) of the Web server WS, the user can execute bidirectional communication between the client terminal PC and the Web server MS. Also, the client terminal PC can display, on the display 5A, contents of various data received from the Web server WS, and carry out an automatic performance by reproducing the received auxiliary melody data along with main melody data and various other processes. Of course, the client terminal PC need not necessarily be in the form of a personal computer. Further, a plurality of the client terminals PC and Web servers WS, rather than just one client terminal PC and Web server WS, may be connected to the communication network 11B.

The portable communication terminal MT is a small-sized terminal, such as a cellular phone or PDA (acronym for Personal Data (Digital) Assistant), which is capable of wireless communication and which has, in addition to its basic communication function, automatic performance functions such as for reproducing alarm sounds and BGM sounds during a call. Therefore, similarly to the above-described client terminal PC, the portable communication terminal MT can carry out an automatic performance by reproducing the main melody data and auxiliary melody data generated by the Web server WS. However, in a situation where the portable communication terminal MT is connected to the Web server WS for bidirectional communication between the portable communication terminal apparatus MT and the Web server WS, the relay server TS intervenes. Namely, by the relay server TS relaying signal transmission/reception between the portable communication terminal MT and the Web server WS, the portable communication terminal MT can transmit/receive various data to/from the Web server WS.

In the system of FIG. 4, the client terminal PC or portable communication terminal MT creates a main melody through manual input or automatic composition (alternatively, a main melody of an existing music piece may be loaded from the external storage device 9 or the like, or a main melody attached to an electronic mail may be received) and then uploads the main melody to the Web server WS. In turn, the Web server WS generates an auxiliary melody on the basis of the main melody uploaded from the client terminal PC or portable communication terminal MT and then delivers the thus-generated auxiliary melody to the client terminal PC or portable communication terminal MT. At this point, a billing process may be performed for charging an amount of money to be paid for the auxiliary melody generated by the Web server WS. In this way, the client terminal PC or portable communication terminal MT can execute an automatic performance using the created (or loaded) main melody and auxiliary melody received from the Web server WS. Because it is not necessary to install the auxiliary-melody generating program in the client terminal PC or portable communication terminal MT, the above-mentioned arrangements can significantly reduce the necessary memory capacity of the client terminal PC or portable communication terminal MT, thereby reducing the overall size and weight of the client terminal PC or portable communication terminal MT.

In the case where the above-described auxiliary melody generation apparatus is applied to an electronic musical instrument, the electronic musical instrument may be other than a keyboard type, such as a stringed instrument, wind instrument or percussion instrument type. It should also be appreciated that the electronic musical instrument is not limited to the type where the tone generator device, automatic performance device, etc. are incorporated together within the body of the electronic musical instrument, and may be of another type where the tone generator device, automatic performance device, etc. are provided separately from each other but can be connected with each other via MIDI interfaces and communication facilities such as a communication network. Further, the electronic musical instrument may comprise a combination of a personal computer and application software, in which case various processing programs may be supplied from a storage medium, such as a magnetic disk, optical disk or semiconductor memory or via a communication network. Further, the auxiliary melody generation apparatus of the invention may be applied to a karaoke apparatus, player piano, electronic game apparatus, portable communication terminal such as a cellular phone, etc. In the case where the auxiliary melody generation apparatus is applied to a portable communication terminal, the auxiliary melody data generated or delivered from a server may be attached to an electronic mail along with the main melody data for transmission to another terminal, in addition to being reproduced as an incoming-call alerting sound, alarm sound or BGM.

It should also be appreciated that the performance data such as the generated auxiliary melody data and main melody data may be in any desired format, such as: the "event plus absolute time" format where the time of occurrence of each performance event is represented by an absolute time within the music piece or a measure thereof; the "event plus relative time" format where the time of occurrence of each performance event is represented by a time length from the immediately preceding event; the "pitch (rest) plus note length" format where each performance data is represented by a pitch and length of a note or a rest and a length of the rest; or the "solid" format where a memory region is reserved for each minimum resolution of a performance and each performance event is stored in one of the memory regions that corresponds to the time of occurrence of the performance event.

Furthermore, where performance data sets for a plurality of channels are handled in the present invention, the performance data sets for the plurality of channels may be stored together in a mixture or the performance data sets for the channels may be separated from each other on a track-by-track basis.

In summary, the present invention can generate additional notes to individual component tones of a main melody, without being supplied with chord progression. Thus, the present invention achieves the benefit that it can generate an auxiliary melody corresponding to a main melody through simplified processing.

Further, because the present invention is arranged to impart particular notes of the main melody with additional notes having predetermined musical intervals therefrom and impart the other notes of the main melody than the particular notes with additional notes having musical intervals therefrom that can provide good note-to-to connections, it can generate an auxiliary melody that is musically natural and has an enhanced musical perfection throughout the melody.

What is claimed is:

1. An auxiliary melody generation apparatus comprising:

a melody information supply device that supplies melody information of a given main melody; and a processor device coupled with said melody information supply device and adapted to:

classify melody notes into particular notes and other notes than the particular notes, on the basis of the melody information supplied by said melody information supply device and in accordance with a predetermined criterion; and decide additional notes with respect to the classified particular notes and the other notes in accordance with different criteria set for the classified particular notes and the other notes, wherein an auxiliary melody is composed of the additional notes decided by said processor device.

2. An auxiliary melody generation apparatus as claimed in claim 1 wherein for each of the classified particular notes, said processor device decides an additional note having a predetermined musical interval from the particular note, and for each of the other notes than the particular notes, said processor device decides an additional note having a musical interval determined on the basis of a flow of at least one of the main melody and the auxiliary melody.

3. An auxiliary melody generation apparatus as claimed in claim 1 wherein said processor device decides one additional note per melody note.

4. An auxiliary melody generation apparatus as claimed in claim 1 wherein said processor device imparts, to the other notes than the particular notes, additional notes taking into account respective musical intervals such that the additional notes progress in a same-pitch progression style or gradual progression style.

5. An auxiliary melody generation apparatus as claimed in claim 1 wherein said processor device classifies the melody notes into the particular notes and the other notes than the particular notes, on the basis of at least one of a downbeat note, note near a downbeat position and long-duration note.

6. An auxiliary melody generation apparatus as claimed in claim 1 wherein said processor device detects a musical key of the main melody represented by the melody information supplied by said melody information supply device and decides pitches of the additional notes in accordance with the detected musical key of the main melody.

7. An auxiliary melody generation apparatus as claimed in claim 1 wherein said processor device imparts, to at least one of the melody notes at the beginning and end of a music piece and at the beginning and end of each phrase of the music piece, an additional note having a same pitch as a tonic of the detected musical key of the main melody.

8. An auxiliary melody generation apparatus as claimed in claim 1 which further comprises a selector coupled to said processor device and adapted to select one of a plurality of musical intervals, and wherein said processor device imparts an additional note of the selected musical interval to the particular note or other note than the particular note.

9. An auxiliary melody generation apparatus as claimed in claim 1 wherein said processor device is adapted to make a determination as to whether the additional notes, imparted to the particular notes or the other notes than the particular notes, include any to-be-inhibited note, and modify the additional notes in accordance with a result of the determination.

10. An auxiliary melody generation apparatus as claimed in claim 1 wherein said processor device is adapted to make a determination as to presence/absence of a melody note or silent melody section having a predetermined duration or longer and decide an additional note for providing a pickup in accordance with a result of the predetermination.

11. An auxiliary melody generation apparatus as claimed in claim 1 wherein said melody information supply device includes a memory storing the melody information of the given main melody.

12. An auxiliary melody generation apparatus as claimed in claim 1 wherein said melody information supply device includes a receiver that receives the melody information of the given main melody via a communication network and supplies said processor device with the melody information received by said receiver.

13. An auxiliary melody generation apparatus as claimed in claim 12 which further comprises a transmitter coupled to said processor device, and wherein said transmitter is adapted to transmit, onto the communication network, auxiliary melody data composed of data of a plurality of the additional notes generated via said processor device.

14. An auxiliary melody generation apparatus as claimed in claim 1 wherein said melody information supply device supplies the melody information of the given main melody in response to real-time performance operation.

15. An auxiliary melody generation method comprising:

a step of supplying melody information of a given main melody;

a step of classifying melody notes into particular notes and other notes than the particular notes, on the basis of the melody information supplied by said step of supplying and in accordance with a predetermined criterion; and a step of deciding additional notes with respect to the classified particular notes and the other notes in accordance with different criteria set for the classified particular notes and the other notes, wherein an auxiliary melody is composed of the additional notes decided by said step of deciding.

16. An auxiliary melody generation method as claimed in claim 15 wherein for each of the particular notes, said step of deciding decides an additional note having a predetermined musical interval from the particular note, and for each of the other notes than the particular notes, said step of deciding decide an additional note having a musical interval determined on the basis of a flow of at least one of the main melody and the auxiliary melody.

17. An auxiliary melody generation method as claimed in claim 15 wherein said step of supplying includes a step of receiving the melody information of the given main melody via a communication network and supplies the melody information received by said step of receiving.

18. An auxiliary melody generation method as claimed in claim 17 which further comprises a step of transmitting, onto the communication network, auxiliary melody data composed of data of a plurality of the additional notes decided by said step of deciding.

19. A program containing a group of instructions to cause a computer to perform an auxiliary melody generation method, said auxiliary melody generation method comprising:

a step of supplying melody information of a given main melody;

a step of classifying melody notes into particular notes and other notes than the particular notes, on the basis of the melody information supplied by said step of supplying and in accordance with a predetermined criterion; and a step of deciding additional notes with respect to the classified particular notes and the other notes in accordance with different criteria set for the classified particular notes and the other notes, wherein an auxiliary melody is composed of the additional notes decided by said step of deciding.

20. A program as claimed in claim 19 wherein for each of the particular notes, said step of deciding decides an additional note having a predetermined musical interval from the particular note, and for each of the other notes than the particular notes, said step of deciding decide an additional note having a musical interval determined on the basis of a flow of at least one of the main melody and the auxiliary melody.

21. A program as claimed in claim 19 wherein said step of supplying includes a step of receiving the melody information of the given main melody via a communication network and supplies the melody information received by said step of receiving.

22. A program as claimed in claim 19 which further comprises a step of transmitting, onto the communication network, auxiliary melody data composed of data of a plurality of the additional notes decided by said step of deciding.

23. A machine-readable storage medium containing a group of instructions to cause said machine to implement an auxiliary melody generation method, said auxiliary melody generation method comprising:

a step of supplying melody information of a given main melody;

a step of classifying melody notes into particular notes and other notes than the particular notes, on the basis of the melody information supplied by said step of supplying, in accordance with a predetermined criterion; and a step of deciding additional notes with respect to the classified particular notes and the other notes in accordance with different criteria set for the classified particular notes and the other notes, wherein an auxiliary melody is composed of the additional notes decided by said step of deciding.

24. A machine-readable storage medium as claimed in claim 23 wherein for each of the particular notes, said step of deciding decides an additional note having a predetermined musical interval from the particular note, and for each of the other notes than the particular notes, said step of deciding decide an additional note having a musical interval determined on the basis of a flow of at least one of the main melody and the auxiliary melody.

25. A method for generating an auxiliary melody on the basis of information communicated between a client apparatus and a server apparatus via a communication network, said method comprising:

a step of causing said client apparatus to transmit melody information of a given main melody to said server apparatus;

a step of causing said server apparatus to classify melody notes into particular notes and other notes than the particular notes, on the basis of the melody information transmitted from said client apparatus and in accordance with a predetermined criterion; and a step of deciding additional notes with respect to the classified particular notes and the other notes in accordance with different criteria set for the classified particular notes and the other notes, wherein an auxiliary melody is composed of the additional notes decided by said step of deciding.

26. A method as claimed in claim 25 wherein for each of the particular notes, said step of deciding decides an additional note having a predetermined musical interval from the particular note, and for each of the other notes than the particular notes, said step of deciding decide an additional note having a musical interval determined on the basis of a flow of at least one of the main melody and the auxiliary melody.

* * * * *